United States Patent [19]

Hibi et al.

[11] Patent Number: 4,768,641

[45] Date of Patent: Sep. 6, 1988

[54] APPARATUS FOR CONVEYING CONTINUOUS CORRUGATED MEMBERS

[75] Inventors: Yasuo Hibi, Obu; Tadahiko Shibata, Nukata; Toshio Yoshizawa, Anjo, all of Japan

[73] Assignee: Nippondenso Co., Ltd., Kariya, Japan

[21] Appl. No.: 19,128

[22] Filed: Feb. 26, 1987

[30] Foreign Application Priority Data

Feb. 27, 1986 [JP] Japan ..... 61-40182

[51] Int. Cl.[4] ..... B65G 15/00

[52] U.S. Cl. ..... 198/408; 198/465.1; 198/482.1; 53/252; 53/534

[58] Field of Search ..... 198/465.1, 424, 425, 198/426, 803.01, 803.2, 408, 465.3, 481.1, 482.1; 221/266; 53/251, 244, 245, 252, 250, 534, 248

[56] References Cited

U.S. PATENT DOCUMENTS

| | | | |
|---|---|---|---|
| 2,855,740 | 10/1958 | Noland, Jr. et al. | 53/250 |
| 3,938,650 | 2/1976 | Holt | 198/425 |
| 4,321,739 | 3/1982 | Martin et al. | 29/157.38 |
| 4,484,432 | 11/1984 | Oberdorf | 53/234 X |
| 4,505,372 | 3/1985 | Sato | 198/408 X |
| 4,613,034 | 9/1986 | Hibi et al. | 198/465.1 |
| 4,625,499 | 12/1986 | Yamaguchi et al. | 53/542 |
| 4,627,215 | 12/1986 | Walz | 53/534 X |
| 4,676,362 | 6/1987 | Malzkorn | 198/465.1 |

FOREIGN PATENT DOCUMENTS 49-3581 1/1974 Japan .

*Primary Examiner*—Robert J. Spar
*Assistant Examiner*—Cheryl L. Gastineau
*Attorney, Agent, or Firm*—Cushman, Darby & Cushman

[57] ABSTRACT

An apparatus for conveying continuous corrugated elongated members having a conveying belt which conveys the corrugated members in the longitudinal direction thereof, a rotor which has open slots for receiving the corrugated members and which is rotatable about an axis parallel to the axis of the rotor, a driving device for intermittently rotating the rotor, a transferring device for forcing the corrugated members fed by the conveying device into the open slots, a plurality of cartridges having grooves for receiving the corrugated members, a carrier for intermittently carrying the cartridges in a direction perpendicular to the longitudinal direction, and a pusher for pushing the corrugated members received in the open slots of the rotor out of the open slots into the receiving grooves of the cartridges.

16 Claims, 10 Drawing Sheets

20
23
A
P
13
21
28
29
30
31
32
36
37
38
39
40
41
43
44
47
48
49
50
51
52
53
53a
53b
55
57
68
69
74
75
76
77
78
79
82
83
84
111
113
181
25

APPARATUS FOR CONVEYING CONTINUOUS CORRUGATED MEMBERS

BACKGROUND OF THE INVENTION

1. Field of the Invention

The present invention relates to an apparatus for conveying continuous corrugated members, such as corrugated fins which are used in the cores of automobile radiators, automobile heaters, condensers in cooling apparatuses in automobiles, or other heat exchangers, or the like. In particular, the present invention relates to an apparatus for conveying continuous corrugated members, cut to predetermined lengths and having predetermined number of crests, one by one from a corrugated member forming apparatus in which the corrugated members are continuously made, to a subsequent assembly station, such as a core assembly apparatus, at a very high speed.

2. Description of the Related Art

In, for example, a radiator core assembly lines, fins are discharged one by one from a fin forming apparatus in which relatively weak corrugated fins having a predetermined number of crests are continuously made. The fins discharged from the fin forming apparatus are fed one by one into a core assembly apparatus, in which the corrugated fins and heat exchanging tubes are alternatively aligned to form a core assembly for, for example, radiators, by a fin feeding apparatus. Between the fin feeding apparatus and the fin forming apparatus is provided a fin conveying apparatus, which conveys the fins one by one.

The fin forming apparatus usually has a fin forming station in which corrugated fins are continuously made from an elongated sheet (blank) and are continuously fed in the direction of the length thereof, a crest contracting station in which the pitch of the crests of the corrugated fins is contracted, and a cutting station in which the corrugated fins are cut to a predetermined length having a predetermined number of crests prior to or subsequent to the contraction of the pitch of the crests. The corrugated fins having the predetermined number of crests are continuously fed in the length direction thereof from the fin forming apparatus after undergoing cutting and contraction operations in the cutting and contracting stations.

To realize an automatic assembly line, the fin forming apparatus and the core assembly apparatus are associated with each other in such a manner that the corrugated fins made by the fin forming apparatus are successively and automatically fed into the core assembly apparatus. Recently, an increase in the speed of formation of the corrugated fins in the fin forming apparatus and the assembly of the cores in the core assembly apparatus has been attempted, in response to a need to increase the speed of formation of the cores as a whole. In order to respond to this speed increase requirement, it is necessary to realize a conveying apparatus which can stably convey the fins continuously discharged from the fin forming apparatus, into the core assembly apparatus at a high speed.

In conventional fin conveying apparatuses, the fins which are continuously discharged from the fin forming apparatus in the lengthwise direction of the fins are fed one by one in the same lengthwise direction into the core assembly apparatus. It is necessary to hold a temporary stock of the fins between the fin forming apparatus and the core assembly apparatus, to ensure a smooth feed of the fins, taking the speed of formation of the fins in the fin forming apparatus into consideration. This means the use of a very large space for stocking the fins.

To solve the problem mentioned above, there is also known a fin conveying apparatus in which the fins continuously discharged from the forming apparatus along a first path extending in the lengthwise direction of the fins are pushed onto a second path which extends perpendicular to the first longitudinal path, by means of a pusher, such as a pneumatic cylinder device (see, e.g., U.S. Pat. Nos. 4,613,034, 4,321,739). With this arrangement, the fins can be effectively stocked in the second path perpendicular to the lengthwise direction. However, in this arrangement, it is necessary to prevent the fins, which are relatively weak and elastic, from deformation or misalignment in the passage during the conveyance from the first path to the second path and during the passage of the fins along the second path.

Conventionally, the means for a transition of the fins from the first path to the second path perpendicular to the first path includes a chute or an inclined plate which extends between the first and second paths, so that the fins are pushed onto the chute from the first longitudinal path and then slide down the chute onto the second lateral path. However, since the fins are allowed to slide freely down the chute, the fins may fall off the chute or the second path or may have an irregular posture, particularly in the case where the feeding speed of the fins is very high.

It is also known to use conveyance bars having rolling wheels at opposite ends thereof which convey the fins transferred onto the second path from the chute. Also in this conventional solution, the corrugated fins may be deformed or fall off the chute under a high speed feeding of the fins.

SUMMARY OF THE INVENTION

The primary object of the present invention is, therefore, to provide an improved apparatus for conveying continuous corrugated members, which apparatus is free from the aforementioned drawbacks and which includes means for successively conveying the continuous corrugated members in the longitudinal direction thereof, a rotor which is rotatable about an axis parallel to the conveyance direction of the corrugated members by the conveying means and which is provided with open slots extending in the axial direction of the rotor through the length of the rotor, driving means for intermittently rotating the rotor so that the rotor intermittently rotates at a predetermined angle, passing a predetermined discharging position in which one open slot comes into alignment with the conveying means, means for transferring the corrugated members fed by the conveying means one by one, into the slot of the rotor which is in the discharging position, in the longitudinal direction of the slot, a plurality of cartridges having receiving grooves, each groove receiving one corrugated member, means below the rotor for intermittently carrying the cartridges in a direction perpendicular to the axis of the rotor to bring the cartridges into a predetermined receiving position in which the receiving groove of one cartridge is positioned directly below and opposed to one open slot of the rotor when the open slot is directed downward in a vertical direction, and means for charging the corrugated members in the open slots of the rotor into the receiving grooves of the cartridges when the open slots of the rotor are opposed to the receiving grooves of the cartridges. With this arrangement, the corrugated members which are fed in the longitudinal direction thereof are transferred into the open slots of the rotor by the conveying means and are then charged into the receiving grooves of the cartridges from the open slots of the rotor by the charging means, to carry the corrugated members in the lateral direction normal to the longitudinal direction. Accordingly, the corrugated members can be effectively stocked in the passage of the conveyance of the corrugated members. In addition, the corrugated members are transferred into the receiving grooves of the cartridges from the open slots of the rotor, and accordingly, the direction of the movement of the corrugated members changes during the transfer thereof between the open slots of the rotor and the receiving grooves of the cartridges. The change in direction of feed of the corrugated members enables an increase in the feeding speed of the corrugated members without causing a problem wherein the corrugated members may fall from the feed passage or be deformed during the conveyance. Also, since the corrugated members are fed while being loaded in the receiving grooves of the cartridges after the direction of the feed changes, the corrugated members cannot fall out or be deformed, and as a result of this, the corrugated members can be stably fed to a subsequent assembly station, thus meeting the requirement of the manufacturers of for example, core assemblies for automobile radiators, for an increased assembly speed.

BRIEF EXPLANATION OF THE DRAWINGS

The invention will be described in detail below with reference to the accompanying drawings, in which.

DESCRIPTION OF THE PREFERRED EMBODIMENTS

FIGS. 1 to 7 show an embodiment of the present invention, in which an apparatus for conveying continuous corrugated members according to the present invention is applied to an apparatus for forming continuous corrugated fins for a heat exchanger.

FIGS. 8 to 12 show different operational positions of a main part of the corrugated fin forming apparatus.

Figure 1:
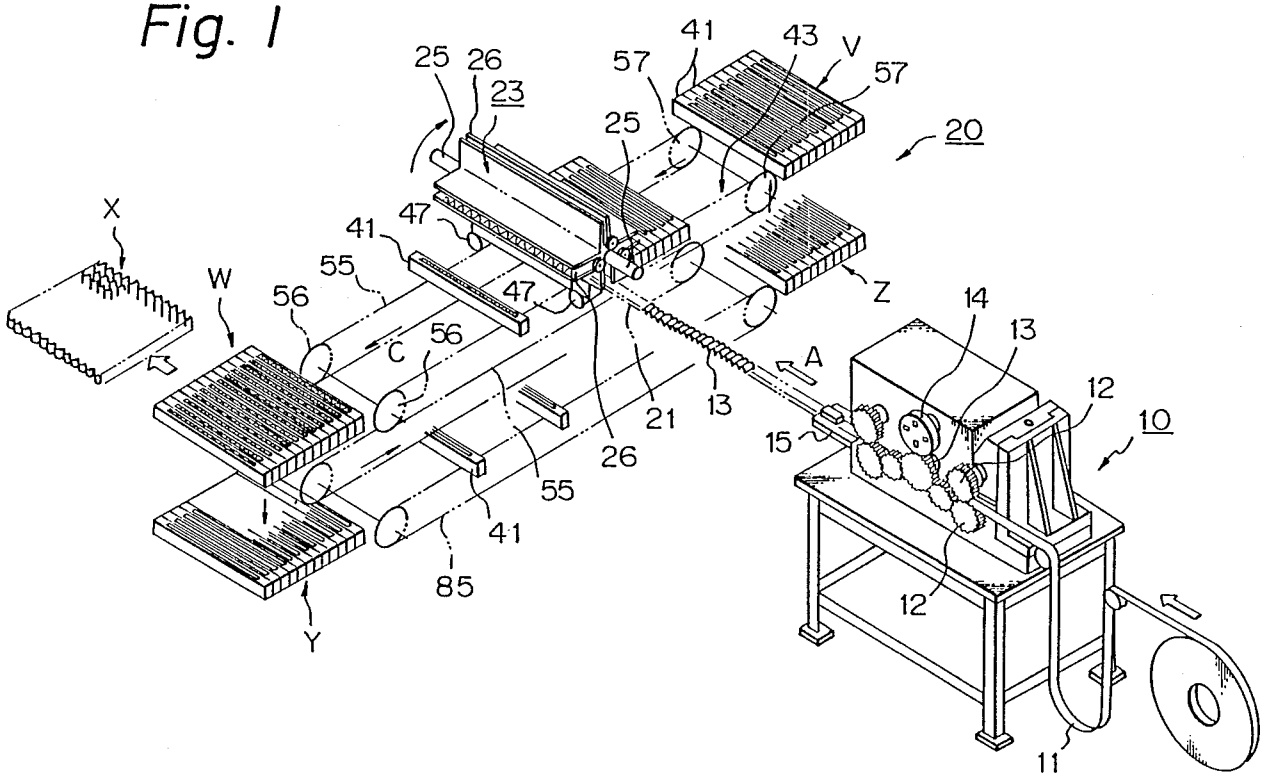
FIG. 1 is a schematic perspective view of an apparatus for conveying continuous corrugated members, which is applied to a corrugated fin forming apparatus, by way of an example, according to the present invention.

FIG. 1 schematically shows a fin forming apparatus 10 and a fin conveying apparatus 20, and an elongated plate 11, i.e., a blank material for corrugated fins, is successively corrugated by a pair of toothed rollers 12 of the fin forming apparatus 10. The continuous corrugated fins 13 are successively discharged from the toothed rollers 12 and are cut to a predetermined length having a predetermined number of crests by a cutting unit 14 of the fin forming apparatus, during the passage thereof at a constant speed through the fin forming apparatus 10.

The corrugated fins 13 cut to a predetermined length and having a predetermined number of crests are successively contracted in the longitudinal direction A of the corrugated fins 13 by a contracting unit 15 provided at the downstream end of the fin forming apparatus 10. Alternatively, it is also possible to provide the contracting unit 15 upstream of the cutting unit 14, so that the corrugated fins are cut after contraction.

Figure 5:
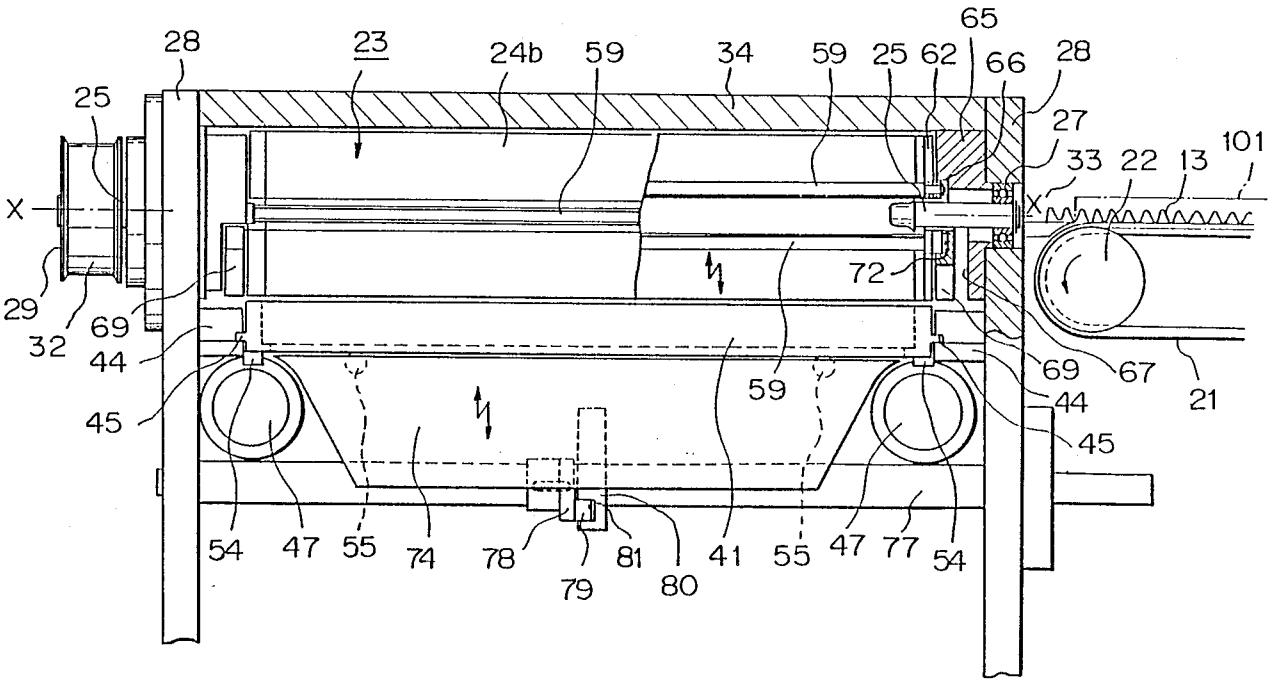
FIG. 5 is a partially sectioned end view of a main part of the conveying apparatus shown in FIG. 1.

The conveying apparatus 20 has an endless conveying belt 21 (FIGS. 3 and 5) which extends in the longitudinal direction A to convey the corrugated fins 13 discharged from the fin forming apparatus 10, in the longitudinal direction A, in the same longitudinal direction. The conveying belt 21 is wound around a pair of pulleys 22, only one of which is shown in FIG. 5. Preferably, the conveying belt 21 conveys the corrugated fins 13 at the same speed as that when the corrugated fins 13 are discharged from the fin forming apparatus 10. Preferably, guide plates 101 (FIG. 5) are provided on either side of the belt 21 to guide the corrugated fins 13 during the movement thereof by the conveying belt 21, to prevent them from falling from the belt 21. As shown in FIG. 3, the corrugated fins 13 are fed by the conveying belt 21 at a substantially constant distance (pitch) P in the longitudinal direction A.

Figures 3A, 3B:
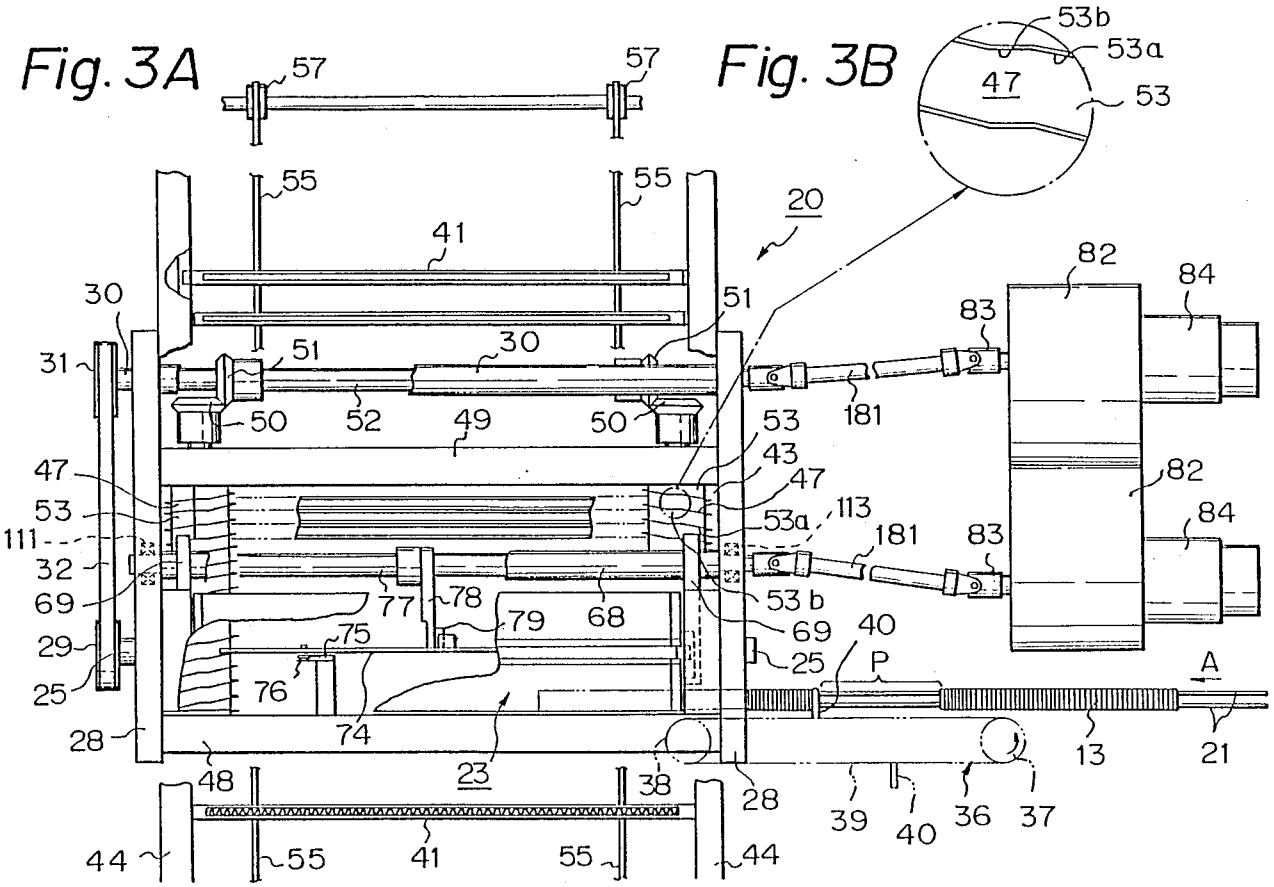
FIG. 3A is a partially broken plan view of a main part of the conveying apparatus shown in FIG. 1.
FIG. 3B is an enlarged view of a circled portion of FIG. 3A.

The conveying apparatus 20 is provided with a rotor 23. In the illustrated embodiment, the rotor 23 has a rotor body 24*a* with four channeled blades 24*b*, which are arranged substantially in the shape of a cross upon the rotor body 24*a*, and shafts 25 which project from the opposite ends of the rotor body 24*a*. The blades 24*b* are each provided with an open slot 26 which extends in parallel with the axis of the shafts 25. The slots 26 extend through the entire axial length of the blades 24*b*, so that the slots 26 are open at opposite axial ends. The slots 26 are also open radially outward. As can be seen from FIG. 5, the shafts 25 of the rotor 23 are rotatably supported by fixed side frames 28 through bearings 27, only one of which is shown in FIG. 5. The axis X—X (FIG. 5) of the rotation of the rotor 23 is parallel with the direction of feed of the corrugated fins 13 by the conveying belt 21. One of the shafts 25 of the rotor 23 is secured to a pulley 29 in such a manner as to rotate with the associated shaft 25. The pulley 29 is connected through a belt 32 to a pulley 31, which is in turn secured to a drive shaft 30 connected to a drive source, such as an electrically driven motor 84 (FIG. 3A).

Figure 4:
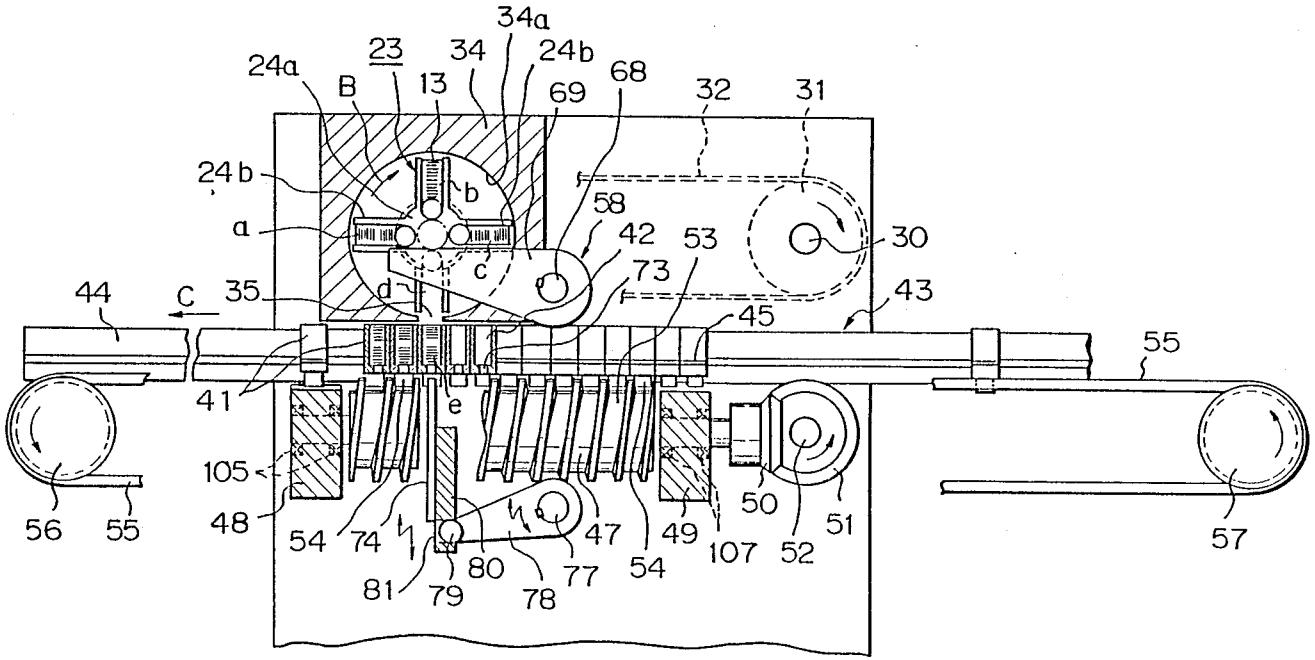
FIG. 4 is a partially sectioned side elevational view of a main part of the conveying apparatus shown in FIG. 1.

In the illustrated embodiment, the rotor 23 is intermittently rotated by the drive source in 90° steps in the clockwise direction B in FIG. 4, so that the open slots 26 make a brief stop at angular positions a, b, c, and d spaced at 90° from one another for a predetermined time. The open slots 26 of the rotor 23 come into alignment with the conveying belt 21 through guide plates 33, which are provided between the discharge end of the belt 21 and the rotor 23 to guide the corrugated fins 13 from the belt 21 to the rotor 23, when the slots 26 are in the first angular position a in FIG. 5.

Namely, the slot 26 which occupies the first angular position a in FIG. 4 is located in an extension of the longitudinal conveyance passage of the corrugated fins 13 on the conveying belt 21. As can be seen from FIG. 4, the rotor 23 is accommodated in a guide block 34 having a cylindrical inner surface 34*a*.

The guide block 34 is secured to the side frames 28, and is provided, at the lower end thereof, with an opening 35 having a width substantially identical to the width of the open slots 26 of the rotor 23.

As is apparent from FIG. 3, the conveying apparatus 20 has a feeding unit 36 which feeds the corrugated fins 13, which are conveyed to a predetermined feeding position by the conveying belt 21, into the open slots 26 of the rotor 23 which are located at the first angular position a in FIG. 4. The fin feeding unit 36 has an endless belt 39 wound around pulleys 37 and 38, and a portion thereof is located along side and in parallel with the endless conveying belt 21, as shown in FIG. 3A. The endless belt 39 has an abutment 40 which projects outward therefrom and abuts against the tail ends of the corrugated fins 13 on the conveying belt 21, so that when the endless belt 39 rotates in the counterclockwise direction in FIG. 3, the projecting abutment 40 abuts against the tail ends of the corrugated fins 13 on the conveying belt 21 and pushes the corrugated fins 13 in the direction A of the conveyance of the corrugated fins 13 by the conveying belt 21. As a result, the corrugated fins 13 are forced into the open slots 26, which are located at the first angular position a in FIG. 4, from one end of the rotor 23 in the axial direction thereof (see also FIG. 8).

The conveying apparatus 20 has a plurality of cartridges 41, each having a receiving groove 42 for receiving one corrugated fin 13 from above. Below the rotor 23 is provided a cartridge carrying device 43 for carrying the cartridges 41 in the direction C (FIG. 4) perpendicular to the axis X—X of the rotor 23. The cartridge carrying device 43 includes a pair of parallel guide rails 44 which extend in the direction C perpendicular to the axis X—X of the rotor 23 and are secured to the guide frames 28. The cartridges 41 are slidably supported by and in guide grooves 46 which are formed in the guide rails 44 and extend in the direction C.

The cartridge carrying device 43 includes a pair of opposed parallel worm shafts 47 below the guide rails 44. The worm shafts 47 are rotatably supported by end frames 48 and 49 (FIG. 4) through bearings 105 and 107.

The end frames 48 and 49 are secured to the side frames 28.

The worm shafts 47 are operatively connected to a drive shaft 52 through bevel gears 50 integral with the worm shafts 47 and bevel gears 51 integral with a driving shaft 52, which is in turn connected to a drive source, such as an electrically driven motor 84 (FIG. 3A), so that when the drive shaft 52 rotates, the worm shafts 47 are continuously rotated at a constant speed.

Each of the cartridges 41 is provided, on the lower portions of the opposite ends thereof, with projections 54 which are engaged in turns of spiral lead grooves 53 of the worm shafts 47. The cartridges 41 supported by the guide rails 44 are carried in the direction C (FIG. 2), in accordance with the rotation of the worm shafts 47, while keeping a posture parallel to the open slots 26 in the first angular position a (FIG. 4), along the guide grooves 46. More precisely, the lead grooves 53 of the worm shafts 47 have spiral groove portions 53*a* and straight groove portions 53*b* which circumferentially extend in a direction perpendicular to the longitudinal axis of the worm shafts 47, as shown in FIGS. 3A and 3B. In the illustrated embodiment, each lead groove 53 is a single thread type of groove and the straight groove portions 53*b* are spaced from one another at an angular distance of about 360°, as viewed in the circumferential direction.

Figure 2:
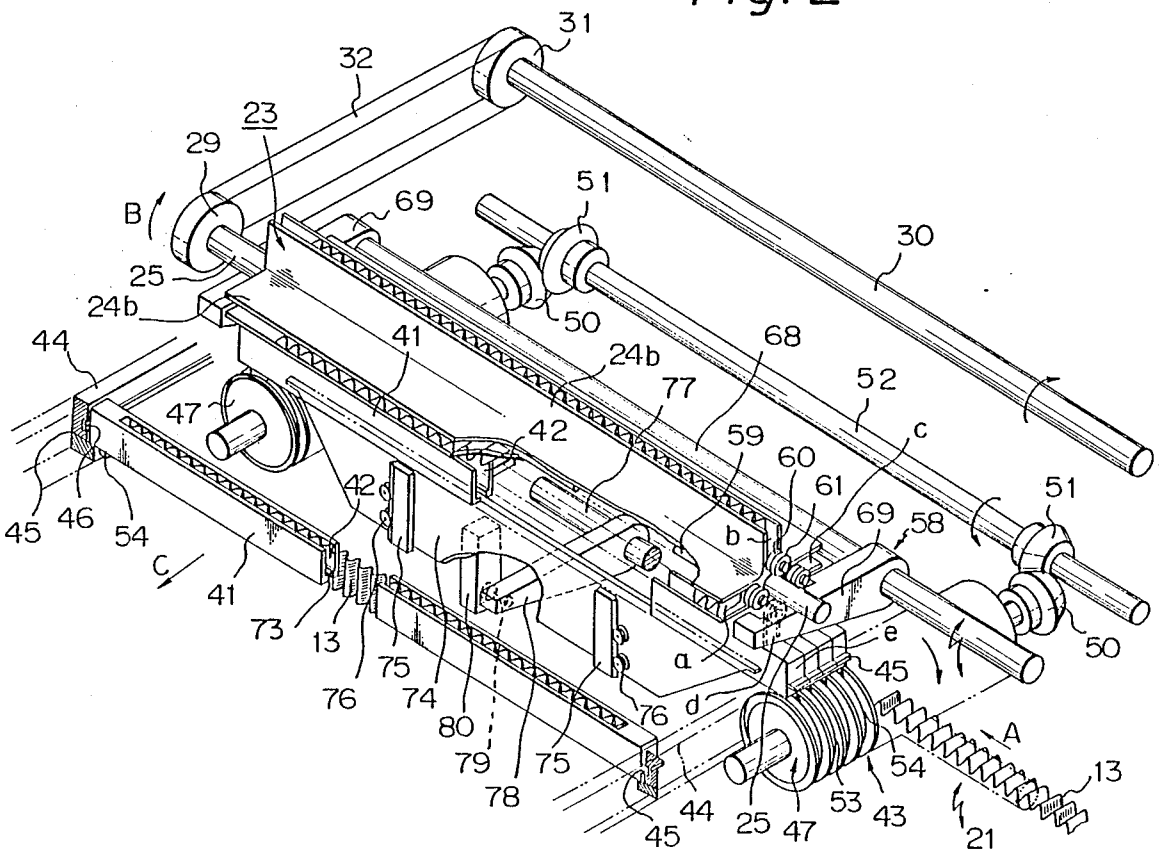
FIG. 2 is a partially broken perspective view of a main part of the apparatus shown in FIG. 1.

It will be appreciated that when the projections 54 of the cartridges 41 are engaged in the spiral groove portions 53*a* of the lead grooves 53 of the worm shafts 47, the cartridges 41 are fed in the direction C in FIG. 2 by the rotation of the worm shafts 47 in the clockwise direction in FIG. 2, and when the projections 54 are engaged in the straight portions 53*b* of the worm shafts 47, the rotation of the worm shafts 47 does not cause an axial movement of the cartridges 41 in the direction C, resulting in a stoppage of the movemert of the cartridges 41. Thus, the cartridges 41 are intermittently displaced in the axial direction C of the worm shafts 47, by one pitch corresponding to one lead of the lead grooves 53, at every one turn of the worm shafts 47. As can be seen from FIGS. 8 to 12, the cartridges 41 are intermittently fed by one pitch by the rotation of the worm shafts 47, one turn of which corresponds to an angular displacement (rotation) of 90° of the rotor 23. Namely, the rotation of the worm shafts 47 is synchronized with the rotation of the rotor 23, so that one turn (360°) of the worm shafts 47 corresponds to a one quarter (i.e., 90°) turn of the rotor 23. A timing relationship is established between the rotor 23 and the worm shafts 47, such that when the open slots 26 of the rotor 23 are directed downward in the vertical direction, to face the receiving grooves 42 of the cartridges 41, and make a temporary stop at that position i.e., when the open slots 26 of the rotor 23 come to the angular position d in FIG. 4 and in FIGS. 8 to 12, and make a temporary stop at that position, the cartridges 41 are temporally stopped at a receiving position e (FIG. 4, and FIGS. 8–12) in which the cartridge 41 is directly below the open slot 26 of the rotor located in the second angular position d, for a predetermined short time, to transfer the corrugated fins 13 from the open slot 26 to the cartridges 41.

It should be appreciated that the worm shafts 47 can be replaced with shafts having double, triple, or more, thread type lead grooves 53. As an alternative, for example, in a double thread type of lead groove, the straight groove portions 53*b* will be spaced from one another at about 180° in the circumferential direction, rather than 360° as in the above embodiment.

The cartridge conveying apparatus further includes a pair of conveyer belts 55 which extend in parallel with the guide rails 44. As can be seen from FIGS. 3A and 4, the conveyer belts 55 are wound around pulleys 56 and 57, one of which, for instance, the pulley 56, is a driving pulley connected to a driving source, such as the motor 84, to rotate in the counterclockwise direction in FIG. 4. The conveyer belts 55 are brought into contact with the bottom surfaces of the cartridges 41. The movement and stoppage of the cartridges 41 in the axial direction C of the worm shafts 47 is controlled by the worm shafts 47 when the projections 54 of the cartridges 41 are engaged in the lead grooves 53 of the worm shafts 47, as mentioned before. After the projections 54 are disengaged from the lead grooves 53 of the worm shafts 47, the cartridges 41 are fed in the same direction C by the conveyer belts 55.

Figure 6:
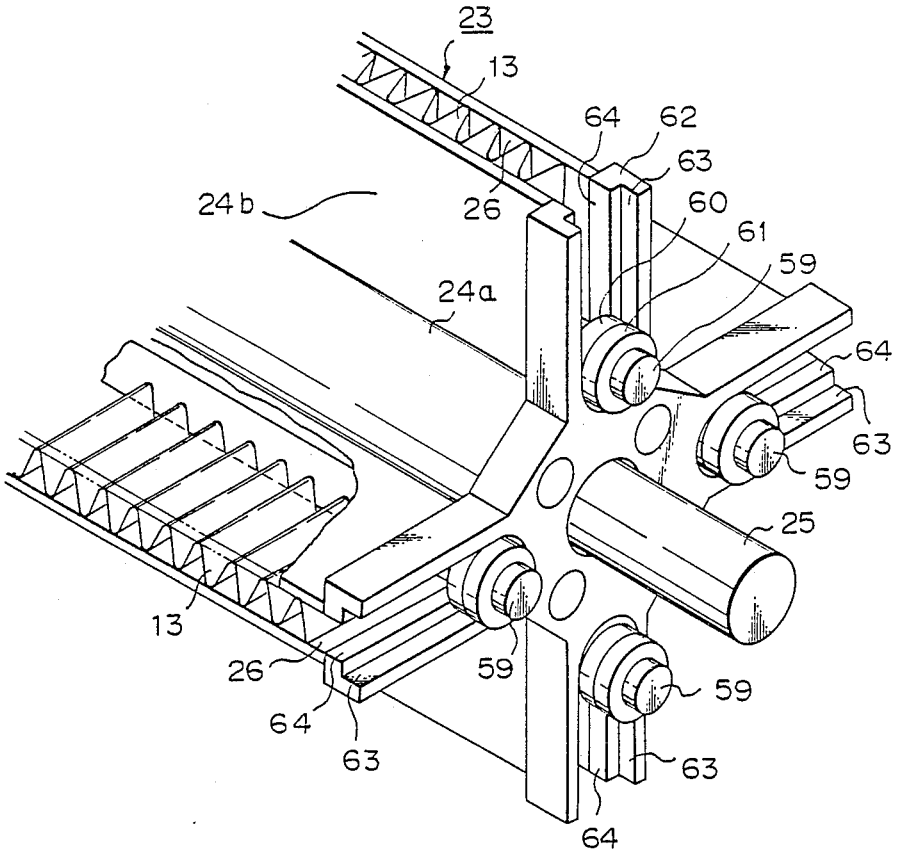
FIG. 6 is a partially broken perspective view of a rotor in the conveying apparatus shown in FIG. 1.

The conveying apparatus 20 has a fin charging device 58 which charges the corrugated fins 13 received in the open slots 26 into the receiving grooves 42 of the cartridges 41, when the slots 26 of the rotor 23 come to a position opposite to the receiving grooves 41. In the illustrated embodiment, the charging device 58 is provided with charging bars 59 (FIG. 6) which are radially movable in the respective open slots 26 of the rotor 23. The charging bars 59 are provided, at the opposite ends thereof, with rotatable guide rollers 60 and 61 (FIG. 6).

The rotor 23 is provided, at the opposite axial ends thereof, with crosswise end plates 62 secured thereto. Note, only one end plate 62 is shown in FIG. 6. Each end plate 62 has four guide channels 63 which extend in the radial direction of the rotor 23 and which open into the respective open slots 26 through openings 64. The guide rollers 60 of the charging bars 59 are slidably fitted in the respective guide channels 63.

Figure 7:
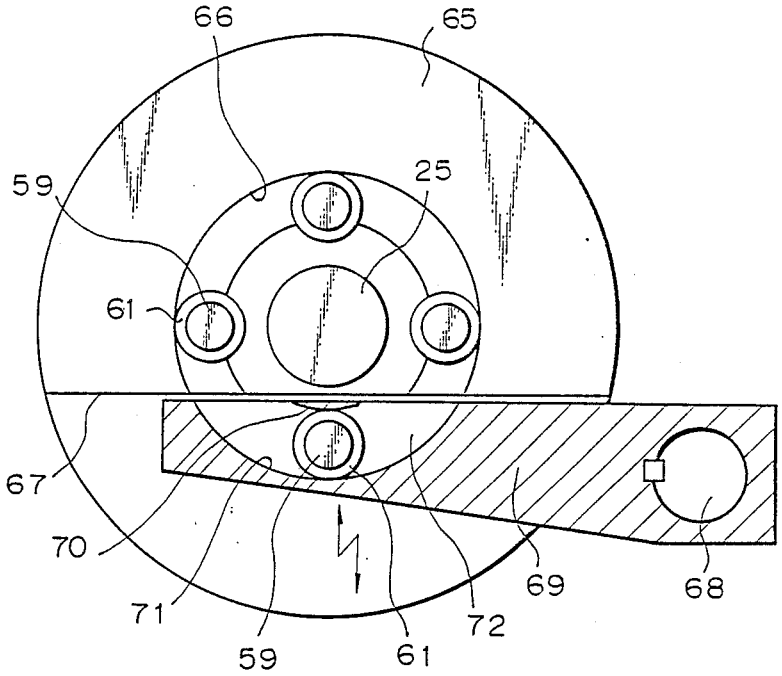
FIG. 7 is a partially sectioned side elevational view of a main part of a fin charging apparatus in the conveying apparatus shown in FIG. 1.
Figure 8:
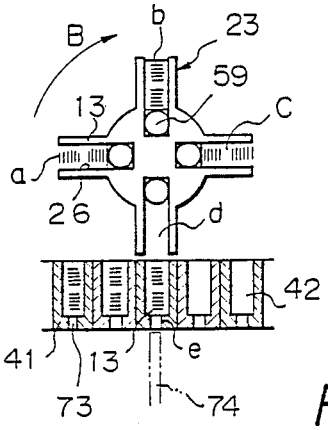
FIGS. 8 to 12 are schematic sectional views of a main part of the conveying apparatus shown in FIG. 1, shown in different operational positions.
Figure 9:
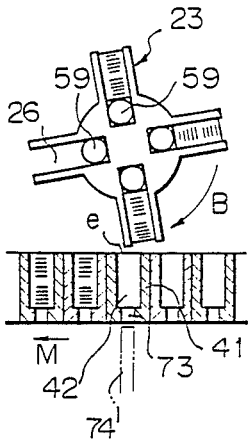

The guide block 34 is provided at the opposite ends thereof, with side plates 62 secured thereto, as can be seen from FIG. 5, which have annular grooves 66 (FIGS. 5 and 7) in which the guide rollers 61 of the bars 59 are guided in the circumferential direction of the rotor 23 to restrict the radially innermost position of the charging bars 59 in the corresponding open slots 26 of the rotor 23. As shown in FIGS. 5 and 7, the side plates 65 are provided, at the lower portions thereof, with recesses 67, so that the lower portions of the annular channels 66 open downward through the recesses 67.

The fin charging device 58 includes swing levers 69 secured to a swing shaft 68, which is in turn rotatably supported by and in the side frames 28 through bearings (not shown). The swing levers 69 have free ends which extend in the recesses 67 of the side plates 65, so that when the swing shaft 68 rotates, the free ends of the swing levers 69 move (swing) substantially up and down in the respective recesses 67.

The charging levers 69 are provided with archwise grooves 72 which are defined by outer peripheral walls 70 and inner peripheral walls 71 formed in the swing levers 69. The guide rollers 61 of the charging bars 59 can move along and in the archwise grooves 72 of the swing levers 69. The inner peripheral walls 71 of the archwise grooves 72 have a same radius as that of the inner peripheral walls of the annular grooves 66 on the side plates 65, so that when the swing levers 69 are in a upper rest position shown in FIG. 7, the inner peripheral wall 71 of the swing levers 69 and the inner peripheral walls of the annular grooves 66 are on the same circumferential line. As a result of this arrangement, when the swing levers 69 are in the upper rest position, the guide rollers 61 of the charging bars 59 are smoothly transferred from the annular grooves 66 of the side plates 65 into the archwise grooves 72 of the swing levers 69, and from the archwise grooves 72 of the swing levers 69 into the annular grooves 66 of the side plates 65, in accordance with the rotation of the rotor 23.

Figure 10:
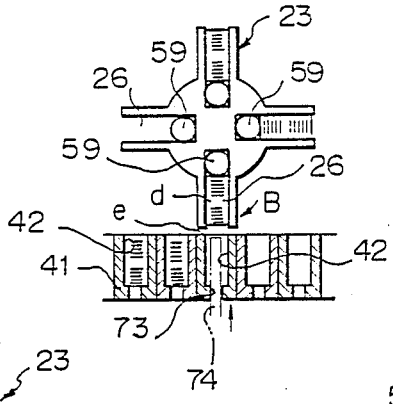
Figure 11:
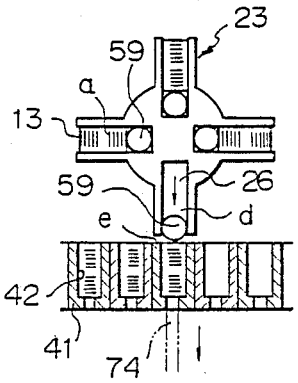
Figure 12:
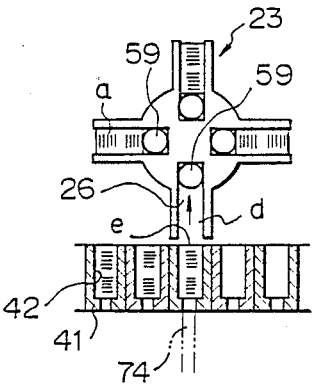

The swing shaft 68 causes the swing levers 69 to rotate synchronously with the intermittent rotation of the rotor 23. More precisely, the swing levers 69 move downward from the upper rest position shown in FIG. 7, to a lower operational position in which the associated corrugated fins 13 are discharged from the associated open slots 26, when the open slots 26 of the rotor 23 are at the second angular position d (FIG. 4). This results in a downward movement of the guide rollers 61 of the charging bars 59, which are located at the second angular position d, by the outer peripheral walls 70 of the swing levers 69 along and in the guide channels 63. The downward movement of the guide rollers 61 pushes downward the corrugated fins 13 received in the slots 26, so that the corrugated fins 13 are forced out of the slots 26 (FIGS. 10 and 11). The charging bars 59 are then moved upward by the swing levers 69 (FIG. 12).

In the illustrated embodiment, the cartridges 41 have slits 73 which extend through the bottoms of the receiving grooves 42, and the charging device 58 has a guide plate 74 (FIGS. 2, 4 and 5) which is movable up and down passing through the slits 73 of the cartridges 41, when the cartridges 41 are in the receiving position e in FIG. 4. The guide plate 74 is provided with guide rollers 76 which roll up and down on upright guide rails 75. The guide rollers 76 are adapted to prevent the guide plate 74 from moving in a lateral direction to the worm shafts 47. As can be seen from FIG. 3A, the guide rails 75 are secured to the end frame 48.

A swing shaft 77 is rotatably supported by the side frames 28 through bearings 111 and 113 (FIG. 3A). The swing shaft 77 has an actuating lever 78 secured thereto which has, at the front end thereof, a roller 79.

The roller 79 is rotatably engaged in a groove 81 which is formed in a block 80 secured to the guide plate 74.

When the rotor 23 and the cartridges 41 are at the positions d and e, synchronously with the intermittent rotational movement of the rotor 23, respectively, the swing movement of the actuating lever 78 causes the guide plate 74 to move up through the slit 73 of the cartridge 41 which is located at the receiving position e (FIG. 10), and then to move down, while supporting the bottom of the corrugated fin 13 received in the slot 26 located at the position d (FIG. 11). The downward movement of the charging bars 59 by the swing levers 69 is synchronous with the downward movement of the guide plate 74, and the speed of the downward movement of the charging bars 59 is identical to that of the guide plate 74 (FIGS. 10 and 11).

Accordingly, an excess force can not be applied to the corrugated fins 13 while the corrugated fins 13 are charged into the cartridges 41 from the rotor 23, so that the corrugated fins 13 can be smoothly transferred into the receiving grooves 42 of the cartridges 41 from the rotor 23, while keeping a horizontal posture in which the longitudinal axes of the corrugated fins 13 lie in the horizontal plane parallel with the open slots 26, with the help of the guide plate 74 and the charging bars 59.

The drive shaft 30, which intermittently rotates the rotor 23, the drive shaft 52 which drives the worm shafts 47, the swing shaft 77 which causes the swing movement of the actuating lever 78, and the swing shaft 68 which causes the swing movement of the swing levers 69, all extend in parallel with each other and are all connected to respective output shafts 83 of respective gear devices 82 by respective joints 181. The gear devices 82 are connected to the respective motors 84.

The intermittent rotation of the drive shaft 30, and accordingly the rotor 23, can be easily achieved by intermittently rotating the associated motor 84 which is, for example, a step motor.

In this case, the gear device 82 for the drive shaft 30 can be omitted, and the drive shaft 30 can be directly connected to the associated motor 84. Similarly, the drive shaft 52 of the worm shafts 47 can be directly connected to the associated motor 84, without the gear device 82. It is also possible to provide gear reduction devices (not shown) between the drive shafts 30 and 52 and the respective motors 84.

On the other hand, a mechanism for reciprocal swing movement of the swing shaft 77 for the actuating lever 78 and the swing shaft 68 for the swing levers 69 is provided in the common or separate gear device(s) 82.

Figure 13:
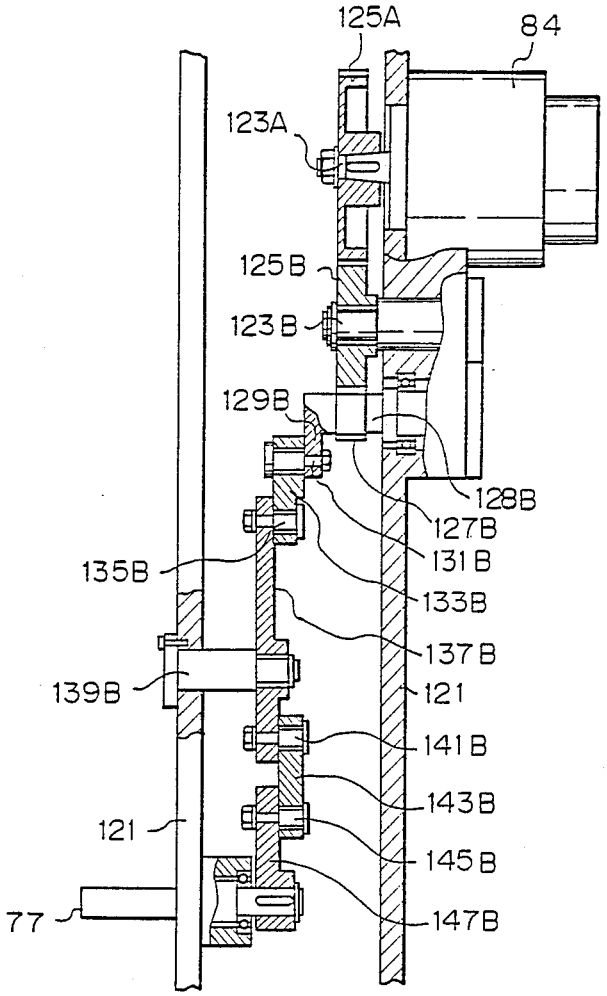
FIG. 13 is a partial sectional side view of a mechanism for a swing movement of swing levers and an actuating lever shown in FIG. 2; and, FIG. 14 is a schematic view of the mechanism shown in FIG. 13.
Figure 14:
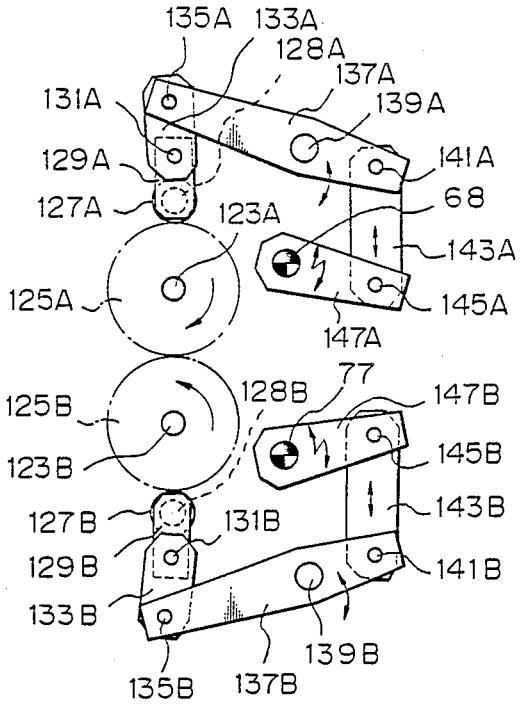

In the arrangement shown in FIGS. 13 and 14, a so-called four-articulated-arm type of link mechanism for the reciprocal swing movement is common to the swing levers 69 and the actuating lever 78, and accordingly, the motor 84 is also common to the swing shafts 77 and 68. In FIGS. 13 and 14, the motor 82 is held by a fixed frame 121 and has an output shaft 123A having a drive gear 125A secured thereto. The drive gear 125A is meshed with a driven gear 125B secured to a shaft 123B, which is in turn rotatably supported by the frame 121. The gear 125B is in mesh with a small gear 127B secured to a rotating plate 129B, which is in turn rotatably supported by the frame 121.

The rotating plate 129B has at the opposite end thereof a pivot shaft 131B on which a first arm 133B is pivoted, the first arm **133*b* is articulated to a second arm 137B by a pivot shaft 135B. The second arm 137B is rotatably supported by an immovable shaft 139B secrred to the frame 121. The second arm 137B is pivotably connected to a third arm 143B by a pivot shaft 141B. The third arm 143B is pivotably connected to a forth arm 147B by a pivot shaft 145B. The swing shaft 77 is secured to the opposite end of the fourth arm 147B, to form an angular displacement together with the fourth arm 147B. The link arrangement for a swing movement of the swing shaft 68 is symmetrical with the link arrangement for the swing shaft 77** mentioned above, and accordingly, the corresponding elements are designated by the corresponding numerals with suffixes A in place of B, and thus a detailed explanation thereof is omitted herein.

With the provision of the articulated link mechanism, when the motor 82 rotates, the gears 125A and 125B synchronously rotate in opposite directions. When the gears 125A and 125B rotate, the small gears 127A and 127B rotate, so that the rotating plates 129A and 129B rotate about the respective shafts 128A and 128B, which are rotatably supported by the frame 121. The rotation of the rotating plates 129A and 129B about the respective shafts 128A and 128B causes the reciprocal swing movement of the second arm 137A and 137B about the respective immovable shafts 139A and 139B, through the first arms 133A and 133B, respectively. The swing movement of the second arms 137A and 137B causes the third arms 143A and 143B to move substantially up and down in FIG. 14. The up and down movement of the third arms 143A and 143B causes the swing shafts 68 and 77 to reciprocally rotate by a predetermined angular displacement, which depends on the arm lengths of the four arms and the positions of the pivots thereof, etc., while keeping the axes of the swing shafts 68 and 77 in the same positions. Namely, the swing shafts 68 and 77 reciprocally rotate without changing the positions of the axes thereof.

As a result of the reciprocal angular movement of the swing shafts 68 and 77, the actuating lever 78 and the swing levers 69 swing synchronously with each other within a predetermined angular displacement.

Referring to FIG. 1, the corrugated fins 13 which are successively fed in the longitudinal direction A by the conveying belt 21 are loaded in the open slots 26 of the rotor 23 at the first angular position a and in the longitudinal direction, by the feeding unit 36. The rotor 23, which receives the corrugated fins 13 at the position a, as mentioned above, is intermittently rotated by 90° at one step. On the other hand, the cartridges 41 are fed one pitch by one pitch in the direction C perpendicular to the direction A from a cartridge storing station V, in which a large number of cartridges 41 are stored. When the cartridges 41 reach the receiving position e, the corrugated fins 13 are transferred from the slots 26 of the rotor 23 into the receiving grooves 42 of the cartridges 41, at the second angular position d. At each loading of the corrugated fins 13 into the receiving grooves 42 of the cartridges 41 at the position d, the cartridges 41 are carried in the direction C, one pitch by one pitch, by the worm shafts 47. When the cartridges 41 are disengaged from the worm shafts 47, the cartridges 41 are fed in the direction C by the conveyer belts 55. A predetermined number of cartridges 41 are stocked in a cartridge stocking station W, where the corrugated fins 13 are discharged from the cartridges 41 and are then transported to a subsequent station X.

The blank cartridges 41 are conveyed from the station W to a return station Y, which is located below the station W, and are then returned therefrom to a station Z, which is located below the station V, by a return conveyer 85. The blank cartridges 41 are then lifted to the storage station V.

As can be understood from the foregoing, since the corrugated fins 13 are fed in the direction perpendicular to the longitudinal direction, with the help of the cartridges 41 in which the corrugated fins 13 are loaded, by the cartridge carrying device 43, the corrugated fins 13 can be effectively stocked in the conveyance passage of the cartridge carrying device 43.

In addition, since the conveyance direction of the corrugated fins 13 is changed, because of the transfer of the corrugated fins 13 to the receiving grooves 42 of the cartridges 41 after they are received in the open slots 26 of the rotor 23, the speed of the conveyance of the corrugated fins 13 can be increased without causing the problem wherein the corrugated fins 13 fall from the conveyance passage or are deformed.

After the direction of conveyance of the corrugated fins 13 is changed, since the corrugated fins 13 are conveyed while being held in and by the cartridges 41, the corrugated fins 13 which would otherwise fall from the conveyance passage or be deformed can be stably held in the cartridges 41 without falling from of the conveyance passage or being deformed even at an increased feeding speed of the cartridges 41.

Consequently, the corrugated fins 13 can be stably fed to a subsequent line, such as a core assembly line for automobile radiators at a high speed, to satisfactorily respond to the requirement for a speed up of the manufacturing line.

It has been experimentally confirmed that the speed of manufacture of the fins was restricted to 5000 crests/-min. in view of a stable feed of the fins, in the prior art, but could be increased to 30000 crests/min. in the present invention in which the fin conveying apparatus as constructed above was used.

It is, of course, understood that the present invention is not limited to the illustrated embodiments, but can be easily modified in various ways by those skilled in the field within the scope of the claims. For example, it is also possible to intermittently rotate worm shafts having completely spiral lead grooves without the straight groove portions 53*b*.

We claim:

1. An apparatus for conveying continuous corrugated elongated members, comprising:

means for successively conveying the corrugated members in a longitudinal direction thereof;

a rotor having a plurality of open slots extending in the axial direction of the rotor throughout the length thereof and rotatable about an axis parallel to the direction of coveyance of the corrugated members by the conveying means, which slots intermittently occupy a first angular position in which the slot has a longitudinal axis coincident with the direction of conveyance of the corrugated members such that the corrugated members are received from the conveying means in said open slots of the rotor and a second angular position in which the corrugated members in the open slots are discharged therefrom;

driving means for intermittently rotating the rotor at a predetermined angular displacement, to intermittently bring the rotor to the first and second angular positions, so that the open slots of the rotor come into alignment with the conveying mans at the first angular position;

means for transferring the corrugated members fed by the conveying means into the open slots located in the first angular position, one by one, in the longitudinal direction;

a plurality of cartridges, each having a receiving groove for receiving one corrugated member;

means for intermittently carrying the cartridges in a direction perpendicular to a predetermined corrugated member receiving position in which the receiving grooves of the cartridges are directly opposed to the open slots of the rotor located at the second angular position, to transfer the corrugated members from the open slots into the cartridges; and, means for charging the corrugated members received in the open slots of the rotor into the receiving grooves of the cartridges.

2. A conveying apparatus according to claim 1, wherein said means for successively conveying the corrugated members comprises a conveying belt which extends in the longitudinal direction of the corrugated members to carry the corrugated members to the corrugated member transferring means.

3. A conveying apparatus according to claim 1, wherein said rotor has a substantially cross shape in section, with channeled blades which define the open slots.

4. A conveying apparatus according to claim 3, wherein said channeled blades are spaced from one another at an equiangular distance of 90°.

5. A conveying apparatus according to claim 2, wherein said conveying belt is in alignment with the open slots of the rotor in the first angular position.

6. A conveying apparatus according to claim 3, wherein said rotor comprises a rotor shaft which is connected to a drive source to intermittently rotate the rotor.

7. A conveying apparatus according to claim 6, wherein said means for intermittently rotating the rotor comprises an electrically driven motor which is connected to the rotor shaft of the rotor and which intermittently rotates.

8. A conveying apparatus according to claim 2, wherein said means for transferring the corrugated members into the open slots comprises an endless belt which moves in a direction parallel with the conveying belt and which has an abutment which abuts against tail ends of the corrugated members moved by the conveying belt to push the corrugated members into the open slots of the rotor located at the first angular position.

9. A conveying apparatus according to claim 1, wherein said means for intermittently carrying the cartridges comprises a pair of guide rails in which the cartridges are slidably supported in the direction perpendicular to the axis of the rotor and wormshafts with lead grooves extending along the guide rails, and wherein said cartridges have projections which engage in the lead grooves of the worm shafts.

10. A conveying apparatus according to claim 9, wherein the lead grooves of the worm shafts comprise spiral groove portions and straight groove portions extending normal to the longitudinal axes of the worm shafts, so that no axial movement of the cartridges takes place during the engagement of the projections of the cartridges in the straight groove portions of the lead grooves of the worm shafts.

11. A conveying apparatus according to claim 10, wherein said straight groove portions of the lead grooves of the worm shafts are located at a constant pitch corresponding to the intermittent rotation of the rotor, so that the projections of the cartridges come into engagement with the straight groove portions of the lead grooves in synchronization with the stop of the rotation of the rotor.

12. A conveying apparatus according to claim 1, wherein said means for charging the corrugated members into the receiving grooves of the cartridges comprises charging bars which extend in parallel with the axis of the rotor in the open slots of the rotor so as to move in the radial direction of the rotor in the open slots to force out corrugated members in the open slots.

13. A conveying apparatus according to claim 12, further comprising an actuator for radial movement of the charging bars.

14. A conveying apparatus according to claim 13, wherein said actuator comprises end plates which are provided on both sides of the opposite ends of he charging bars and which have substantially annular grooves in which the opposite ends of the charging bars are fitted, and swing levers which have archwise grooves having the same radius as that of the annular grooves of the end plates, said swing levers being rotatable about axes parallel with the axis of the rotor to selectively occupy a rest position in which the archwise grooves and annular grooves are on the same circumferential line, and an operational position in which the corrugated members in the associated open slots are discharged therefrom by the swing movement of the swing levers.

15. A conveying apparatus according to claim 14, wherein the swing movement of the swing levers is synchronized with the intermittent rotation of the rotor, so that when the open slots come to the second angular position and the cartridges come to the corrugated member receiving position, the swing levels are brought to the operational position to push the corrugated members in the open slots into the receiving grooves of the cartridges.

16. A conveying apparatus according to claim 12, further comprising a guide plate which is located directly below the cartridges located at the corrugated member receiving position and which is connected to a swingable actuating lever which is rotatable about an axis parallel to the axis of the rotor, and wherein said cartridges are provided, on the bottoms thereof, with slits through which the guide plate passes and extends to come into contact with the corrugated members in the open slots of the rotor when the swingable actuating lever swings.

* * * * *